US008424915B2

(12) United States Patent
Haag

(10) Patent No.: US 8,424,915 B2
(45) Date of Patent: Apr. 23, 2013

(54) VEHICLE SERVICE TAG

(76) Inventor: Kenneth R. Haag, Indianapolis, IN (US)

( * ) Notice: Subject to any disclaimer, the term of this patent is extended or adjusted under 35 U.S.C. 154(b) by 71 days.

(21) Appl. No.: 13/170,706

(22) Filed: Jun. 28, 2011

(65) Prior Publication Data

US 2011/0315569 A1 Dec. 29, 2011

Related U.S. Application Data

(60) Provisional application No. 61/358,977, filed on Jun. 28, 2010.

(51) Int. Cl.
*B42D 15/00* (2006.01)
*G09F 21/04* (2006.01)
*G09F 7/22* (2006.01)

(52) U.S. Cl.
USPC ..... 283/23; 283/70; 283/81; 40/591; 40/593; 40/643; 40/617

(58) Field of Classification Search ..... 283/81, 283/70; 40/591, 643, 617, 673
See application file for complete search history.

(56) References Cited

U.S. PATENT DOCUMENTS

| | | | | |
|---|---|---|---|---|
| 4,137,740 | A * | 2/1979 | Eckerdt | 70/456 R |
| 7,246,459 | B2 * | 7/2007 | Lewis | 40/673 |
| 7,293,384 | B2 * | 11/2007 | Lewis | 40/673 |
| 7,316,088 | B1 * | 1/2008 | Lewis | 40/634 |
| 7,900,966 | B1 * | 3/2011 | Stennett | 283/81 |
| 7,950,172 | B1 * | 5/2011 | Lewis | 40/634 |
| 2006/0163868 | A1 * | 7/2006 | Baumann | 283/81 |
| 2007/0204498 | A1 * | 9/2007 | Clevenger | 283/81 |

FOREIGN PATENT DOCUMENTS

JP 2006273421 * 10/2006

OTHER PUBLICATIONS

Derwent Abstract: JP 2006-273421.*

* cited by examiner

*Primary Examiner* — Dana Ross
*Assistant Examiner* — Kyle Grabowski
(74) *Attorney, Agent, or Firm* — Woodard, Emhardt, Moriarty, McNett & Henry LLP

(57) ABSTRACT

A tag system for vehicle repair shops or collision repair centers includes a set of mirror tags, a set of releasably attachable key ring tags with associated key rings, and a set of releasably attachable instruction tags. The mirror tags are adapted to be hung from the rear view mirror of a vehicle, and are reusable to allow each tag to be used multiple times while conveying different information to service personnel. Each mirror tag may include an identifier for identifying the mirror tag, a hook-and-loop attachment strip for releasably attaching a key ring with keys to the vehicle, and a hook-and-loop attachment strip for releasably attaching one or more members of a set of instruction tags. Each key ring tab may include an identifier matching the identifier of the mirror tag, a key ring for holding the key to the vehicle, and a hook-and-loop attachment strip for attaching the key ring to a mirror tag. Each member of the set of instruction tags is adapted to provide instructions regarding the customer and/or the services to be provided to the vehicle and/or the time period during which services are to be provided.

2 Claims, 5 Drawing Sheets

VEHICLE SERVICE TAG

REFERENCE TO RELATED APPLICATIONS

This application claims the benefit of applicant's U.S. Provisional Patent Application No. 61/358,977, filed Jun. 28, 2010, the entire contents of which are hereby incorporated herein by reference.

FILED OF THE INVENTION

The present invention relates generally to hanging tags of the type that are used to identify vehicles left for service, and more particularly to a system of tags that is reusable and may be used to communicate service information.

BACKGROUND TO THE INVENTION

Hanging tags are commonly used to identify vehicles that have been left for service. The tag may be hung from the rear-view mirror, and typically includes a number that identifies the vehicle. A corresponding tag with the same number may be attached to the vehicle key so that the key may be identified as belonging with the vehicle.

Prior mirror hang tags have not been suitable for multiple uses and have not been effective for communicating certain information and instructions to the service shop. Moreover, prior tag systems have not been effective for keeping multiple mirror tags and their respective key tags associated and organized.

A need therefore exists for an improved mirror hang tag system that address the deficiencies of prior art tags. The present invention addresses those needs.

SUMMARY OF THE INVENTION

Briefly describing one aspect of the present invention, there is provided a tag system for vehicle repair shops. The system may include:

a) a mirror tag adapted to be hung from the rear view mirror of a vehicle, wherein said mirror tag includes:

i) an identifier for identifying the mirror tag;

ii) attachment means for releasably attaching a key ring tag with keys to the vehicle; and iii) attachment means for releasably attaching one or more instruction tags;

b) a key ring tag adapted to retain a key to a vehicle, said key ring tag including means for attaching the keys of the vehicle, means for releasably attaching the key ring tag to said mirror tag, and an identifier matching the identifier of the mirror tag; and c) a set of instruction tags for communicating instructions regarding the customer and/or the services to be provided to the vehicle and/or the time period during which services are to be provided to the vehicle on which the tag system is hung, wherein said instruction tags optionally each include means for releasably attaching the instruction tag to said mirror tag.

DESCRIPTION OF THE PREFERRED EMBODIMENTS

Figure 1A:
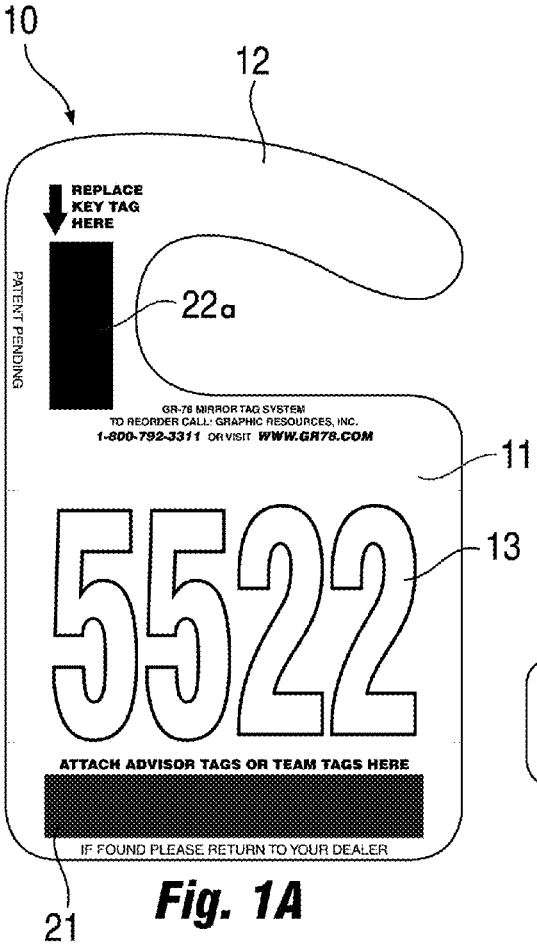
FIGS. 1A and 1B show the front (FIG. 1A) and rear (FIG. 1B) sides of a mirror hang tag according to one embodiment of the present invention.

For the purposes of promoting an understanding of the principles of the invention, reference is made herein to certain preferred embodiments and specific language will be used to describe the same. It will nevertheless be understood that no limitation of the scope of the invention is thereby intended, with such alterations and further modifications in the illustrated invention, and such further applications of the principles of the invention as illustrated therein, being contemplated as would normally occur to one skilled in the art to which the invention relates.

One aspect of the present invention provides a mirror tag system for use by vehicle service shops. The mirror tag system preferably includes a mirror tag, a releasably attachable key ring tags with associated key rings, and a set of releasably attachable instruction tags.

Each mirror tag component preferably includes an identifier (preferably a number) that is unique to the tag, and means for releasably attaching one or more of the instruction tags containing information about the customer and/or the services to be provided. Means for releasably attaching a key ring and identifying tag are also preferably included. The tag is adapted to be hung from the rear-view mirror of a vehicle.

Each key ring tag preferably includes an identifier (preferably a number) that matches the identifier of an associated mirror tag, and means for releasably attaching the key ring tag to a mirror tag.

Each instruction tag preferably includes information about the customer and/or the services to be provided, and means for releasably attaching the instruction tag to a mirror tag.

A container for storing and organizing the mirror tags and associated key ring tags and instruction tags may also be included.

Further describing one embodiment of the mirror tag system, the mirror tag component may be a flat sheet of reusable material such as plastic that is sized to provide sufficient space for identifying the tag number and information about the customer and services, while being hung conveniently from a rear view mirror. In one embodiment the mirror tag is about 5 to 8 inches wide, preferably about 6 inches wide, and about 5 to 10 inches tall, preferably about 9 inches tall. The mirror tag may be made of a material such as Teslin® that is covered by a laminate that can easily be written on with a marker so that custom instructions may be indicated on the tag. For example, the material may be 10 ml Teslin sandwiched in between two 10 ml sheets of P.E.T polyester laminate. In one preferred embodiment the material and marker are "permanent" to the extent that the markings will not easily smudge, yet the markings can be "erased" with an appropriate solvent such as alcohol or brake cleaner. A Sharpie®-type marker may be used to write instructions or notes on the various tags.

The mirror tag is adapted to be hung from the rear view mirror of a vehicle. For example, a curved arm that fits around a rear view mirror post may be used to allow the mirror tag to be hung from the rear view mirror post. In such embodiments the main, message-bearing portion of the mirror tag may be about 6 inches wide by 6 inches tall, and the hanging arm portion may be about 2 inches tall.

The mirror tag includes an identifier for identifying the mirror tag. For example, the identifier may be a number or an alpha-numeric code. The identifier is preferably large enough to be seen easily from a distance of about five to ten feet when the mirror tag is hung from a vehicle rear view mirror. In some embodiments the mirror tag is a flat panel with a number on each side of the tag, with each set of numbers being about 5 inches wide by about 3 inches tall. Identifier numbers may be three-digit numbers, or four-digit numbers, or numbers with more or less digits, with or without letters or other identifying symbols.

The mirror tag also may include means for releasably holding a key ring associated with the vehicle being services. For example, a strip of hook-and-loop material may be fixed to the mirror tag to hold a key ring connected to a corresponding piece of hook-and-loop attachment material. The strip of hook-and-loop material may be sized appropriately to hold a key ring, such as a strip that is about 2 to 3 inches wide and about ¾ inch to 1 inch tall. An instruction to place or replace the key ring and/or the keg tag on the strip of hook-and-loop material may be included.

The mirror tag also may include means for releasably holding one or more instruction tags. For example, a strip of hook-and-loop material may be fixed to the mirror tag to hold members of a set of instruction tags with instructions regarding the customer or services to be provided. The strip of hook-and-loop material may be sized appropriately to hold one, two, three, four, five, or more of such instruction tags, such as a strip that is about 4 to 6 inches wide and about ¾ inch to 1 inch tall.

The mirror tag component is preferably made of a reusable material such as plastic. The material may be of a weight that is heavy enough to withstand many uses over a period of years in a vehicle service or repair shop. Preferably, the instruction tags containing information about the customer and/or the services are also made of a reusable material such as plastic.

A set of instruction tags for use with the mirror tag are also included in the mirror tag system. In one embodiment, each instruction tag is an "advisor" tag that is designed to be used with the mirror tag system by a vehicle service shop, and may contain information about the service event, such as, for example, the customer, the services to be provided, or the time frame during which services are to be provided, etc. For example, instruction tags may be included to optionally identify the customer as an "appointment" customer, as a "wait" customer, as a "first visit" customer, or as a member of some other customer class. Instruction tags may also or alternatively be included to optionally identify the services as including "VIP," "no wash," "lube," "comeback," etc.

In one embodiment the instruction tags may include "team" tags that identify the team that will be repairing or servicing the vehicle. Such team tags may be color coded to facilitate team identification.

In other embodiments, each instruction tag is a "process" tag that is designed to be used with the mirror tag system by a collision repair shop. Such tags may contain information about the collision repair process, such as information about the customer or repair services to be performed, for example, "PDR," "Glass," "Align/Wheel," "A/C," "Service," "Pull-In", "Warning Lamps," "Frame," and "Detail."

Each instruction tag may include means for releasably holding one or more of the instruction tags to a mirror tag. For example, a strip of hook-and-loop material may be fixed to one side of the instruction tag, with the opposite side containing the instruction. The instruction tag and its strip of hook-and-loop material may be sized appropriately to allow one, two, three, four, five, or more of such instruction tags to be releasably attached to a mirror tag. In one embodiment each instruction tag is as a strip that is about 2 to 3 inches tall and about ¾ inch to 1 inch wide, that is positioned at the bottom of the mirror tag. In other embodiments the means for releasably holding instruction tags may be other sizes, and/or may be positioned at other locations, such as on the sides of the tag.

The instruction provided on the instruction tags should be visible from a distance of at least 5 feet to 10 feet when looking at the tag through a vehicle windshield. A bold instruction label is preferred, and various colors may be used to enhance the instructions. For example, a red instruction label may be used to indicate a higher level of importance. Like the mirror tags, the instruction tags may be made of a material that can be used with a Sharpie® type "permanent" marker to allow service personnel to write instructions or markings that will not easily smudge yet can be "erased" with an appropriate solvent.

A set of key ring tags for use with the mirror tag are also included in the mirror tag system. In one embodiment, each key ring tag is releasably attachable to the mirror tag, and includes an identifier that matches the identifier of a specific mirror tag. The key ring tag includes a key ring and metal clasp for holding the keys associated with the vehicle being serviced under the tag system. Like the mirror tag and the instruction tags, the key ring tag may also be made of a material usable with a "permanent" marker to allow service personnel to write instructions or markings that will not easily smudge yet can be "erased" with an appropriate solvent.

The mirror tag system may be kept in a storage box that organizes the various tags and makes them available for quick and easy access and use. In one embodiment the storage box is open to the front to facilitate easy access to the tags. A rod or bar may be included in the box, preferably near the top, so that mirror tags may be hung from the bar to keep them organized and easy to see and use.

Briefly describing the drawings, FIGS. 1 through 3 shows one embodiment of a mirror tag system. FIG. 1A shows the front side of mirror tag 10, comprising a message-bearing portion 11 and an arm portion 12 for hanging the mirror tag from the rear view mirror of a vehicle. An identifier 13 identifies the number of the specific mirror tag. Front side 1A further includes means 21 for releasably attaching instructions tags 18, and means 22*a* for releasably attaching a key ring tag 20.

Figure 1B:
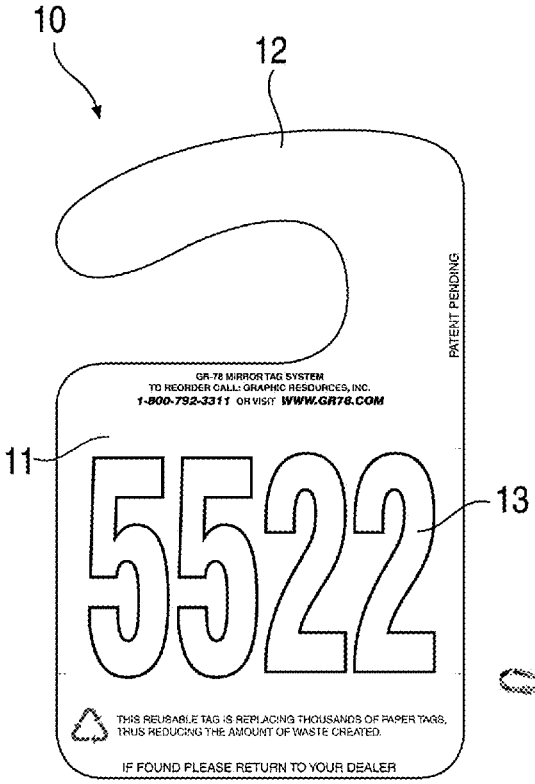

FIG. 1B shows the rear side of mirror tag 10, again comprising a message-bearing portion 11 and an arm portion 12 for hanging the mirror tag from the rear view mirror of a vehicle. The same identifier 13 as is provided on the front side of the tag is provided on this side to identify the number of the specific mirror tag regardless of which side of the tag the service person is viewing.

Figure 2B:
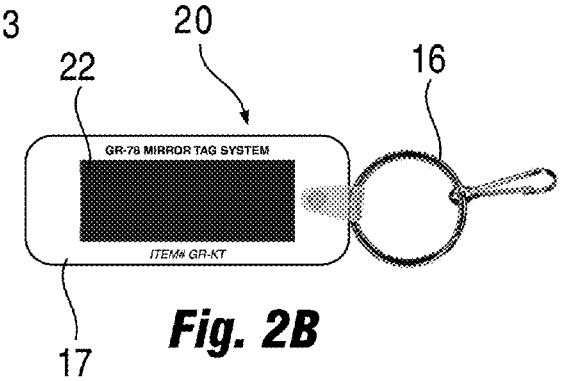
FIGS. 2A and 2B show the front (FIG. 2A) and rear (FIG. 2B) sides of a key ring tag according to one embodiment of the present invention.
Figure 2A:
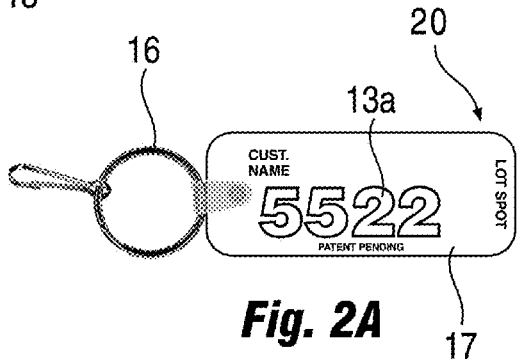

FIG. 2A shows the front side of key ring tag 20. Key ring tag 20 includes a ring 16 that may hold a clasp, and a tag portion 17 with an identifier 13*a* matching the identifier of the mirror tag.

FIG. 2B shows the reverse side of key ring tag 20, including means 22 for releasably attaching key ring tag 20 to the corresponding attachment means 22*a* of mirror tag 10.

Figure 3B:
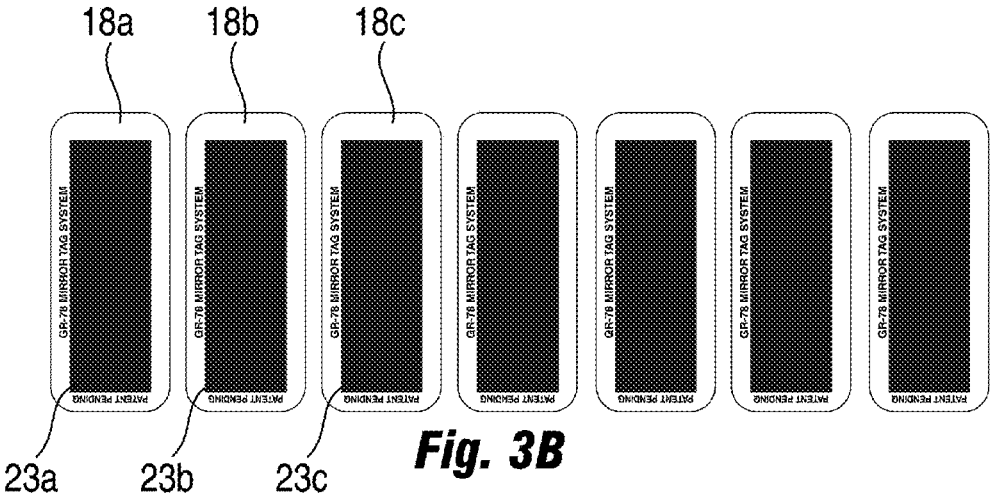
FIGS. 3A and 3B show the front (FIG. 3A) and rear (FIG. 3B) sides of a set of instruction tags according to one embodiment of the present invention.
Figure 3A:
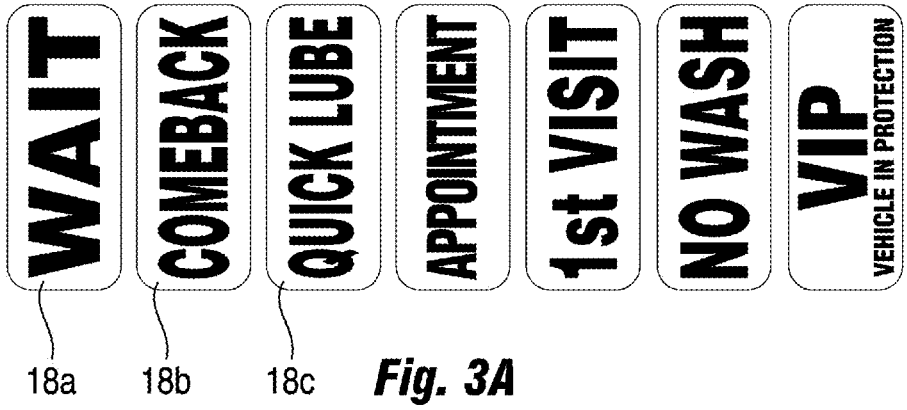

FIG. 3A shows the front side of one illustrative set of instruction tags 18. Instruction tags 18 include information and/or instructions for the service shop such as "wait," "comeback," "quick lube," "appointment," "1st visit," "no wash," "VIP," "lube," etc.

FIG. 3B shows the opposite side of the set of instruction tags 18 illustrated in FIG. 3A. This side of the instruction tag includes means 23*a*, 23*b*, 23*c*, etc., for releasably attaching instruction tags 18 to the corresponding attachment means 21 of mirror tag 10.

Figure 4:
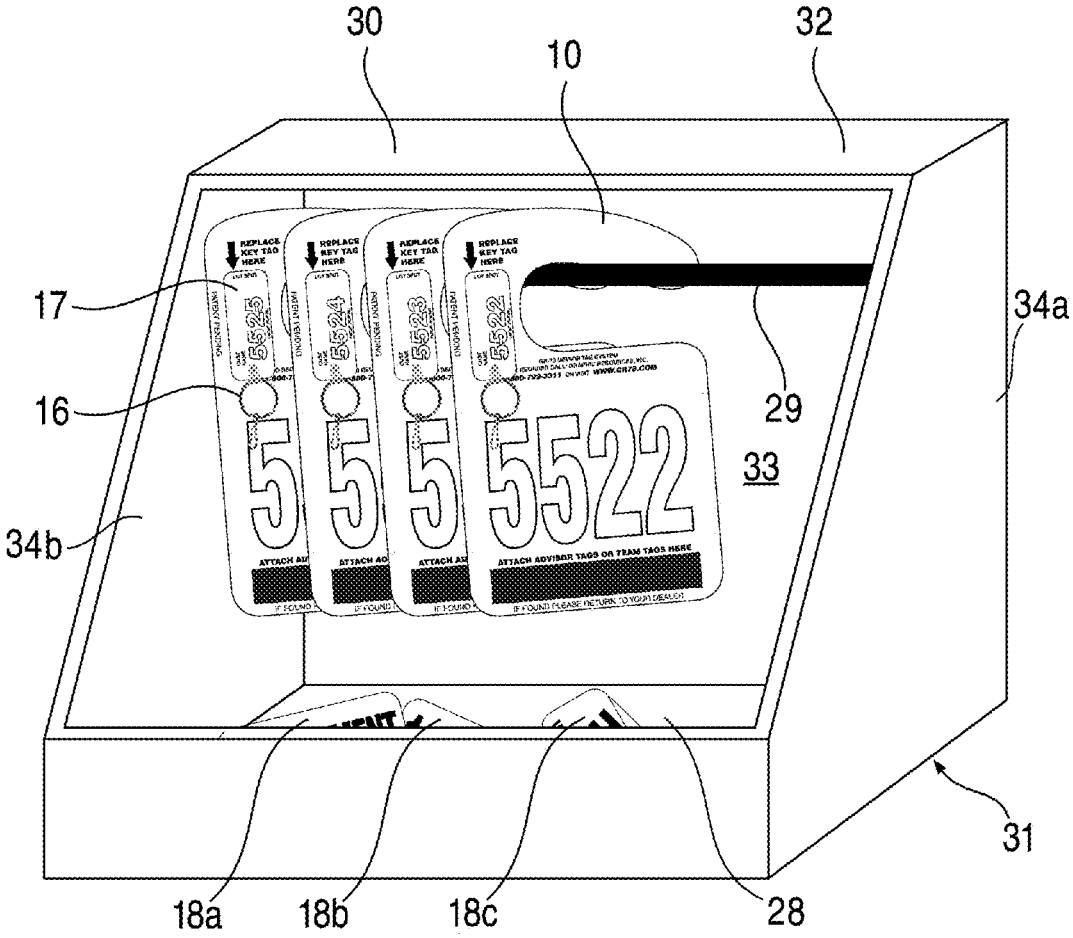
FIG. 4 shows a storage box system for organizing and containing the tag system of the present invention, according to one preferred embodiment.

FIG. 4 shows a storage box that may be used to organize and contain the mirror tag system and make the individual components available for quick and easy use. Storage box 30 is adapted to hold mirror tags 10, key ring tags 17, and instruction tags 18*a*, 18*b*, 18*c*, etc. Storage box 30 may include a rod 29 for hanging the mirror tags when not in use, and a tray 28 for receiving and storing instruction tags. In one preferred embodiment storage box 30 includes one or more of a bottom 31, a top 32, a back 33, and sides 34*a* and 34*b*. Tray 28 may define a front to the box, or a separate front may be provided if desired.

Figure 5A:
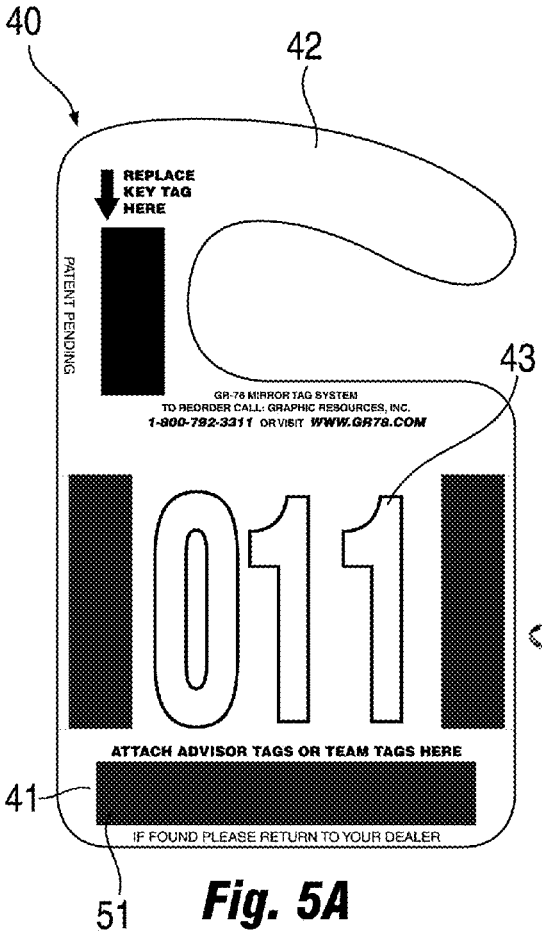
FIGS. 5A and 5B show the front (FIG. 5A) and rear (FIG. 5B) sides of a mirror hang tag according to another embodiment of the present invention.

FIGS. 5-7 show another embodiment of a mirror tag system. FIG. 5A shows the front of mirror tag 40, including a message-bearing portion 41 and an arm portion 42 for hanging the mirror tag from the rear view mirror of a vehicle. An identifier 43 identifies the number of the specific mirror tag. Means 44 for releasably attaching a key ring tag 47 is also included on one side of mirror tag 40, and in the illustrated embodiment it is included on the front side. Means 44 is preferably a hook-and-loop fastener, although other types of connections that allow releasable and multi-use attachment may be used. Also means 51 for releasably attaching one or more instruction tags 48*a*, 48*b*, 48*c*, etc., is also included on one side of mirror tag 40. Like means 44, means 51 is preferably a hook-and-loop fastener, although other types of connections that allow releasable and multi-use attachment may be used.

It is to be appreciated that the means for holding key ring tags and the means for holding instruction tags may be provided on either side of the mirror tag.

Figure 5B:
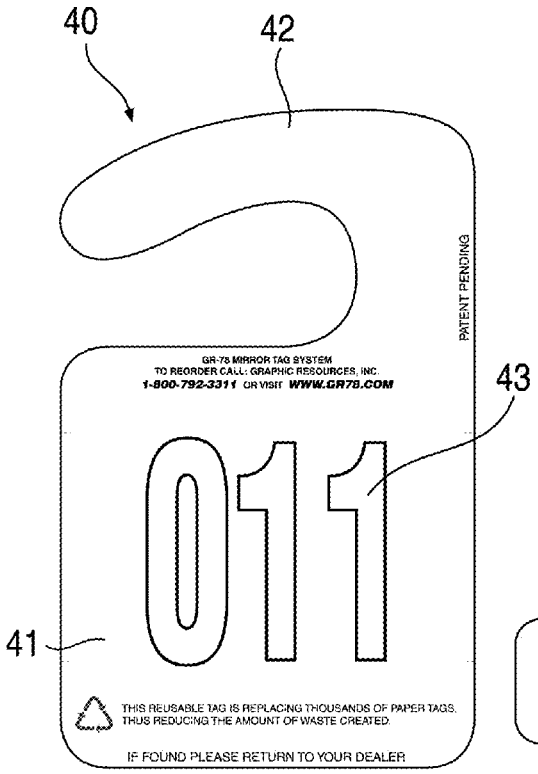

FIG. 5B shows the rear side of mirror tag 40, including identifier 43 that identifies the number of the tag. Identifier 43 is preferably the same as is provided on the opposite side of the tag, so that the number of the specific mirror tag may be observed regardless of which side of the tag the service person is viewing.

Figure 6A:
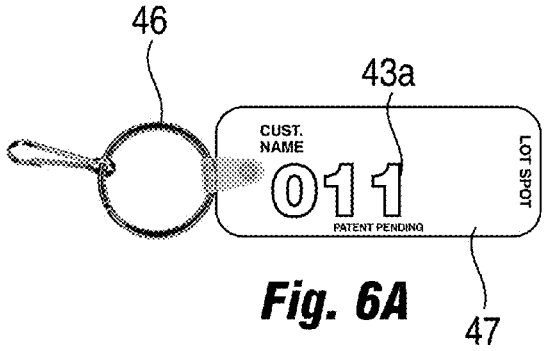
FIGS. 6A and 6B show the front (FIG. 6A) and rear (FIG. 6B) sides of a key ring tag according to another embodiment of the present invention.
Figure 6B:
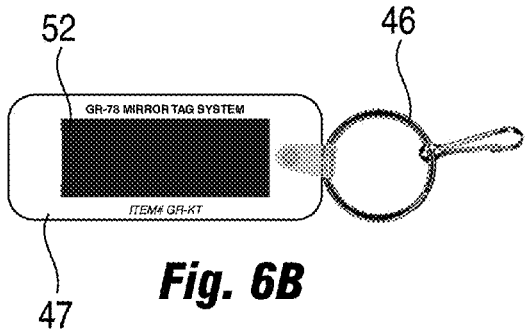

FIG. 6A shows key ring tag 47, which may include a key ring 46 and an identifier 43*a* matching the identifier of the mirror tag. FIG. 6B shows the reverse side of key ring tag 47, including means 52 for releasably attaching key ring tag to mirror tag 40.

Figure 7A:
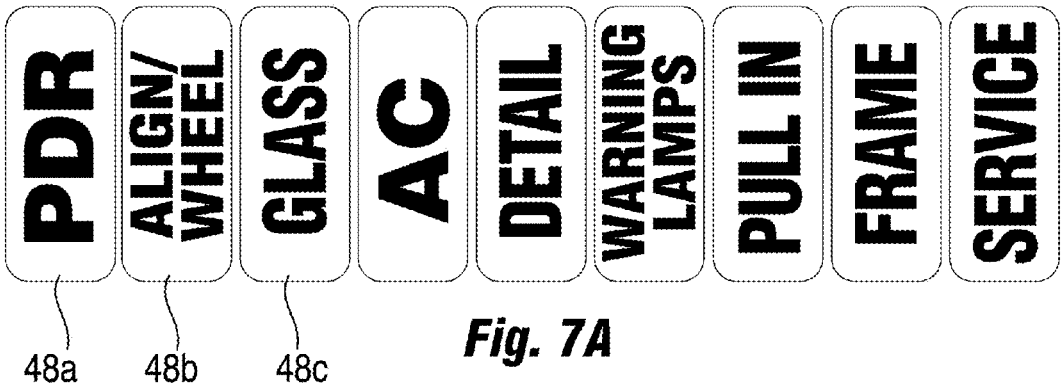
FIGS. 7A and 7B show the front (FIG. 7A) and rear (FIG. 7B) sides of a set of instruction tags according to another embodiment of the present invention.
Figure 7B:
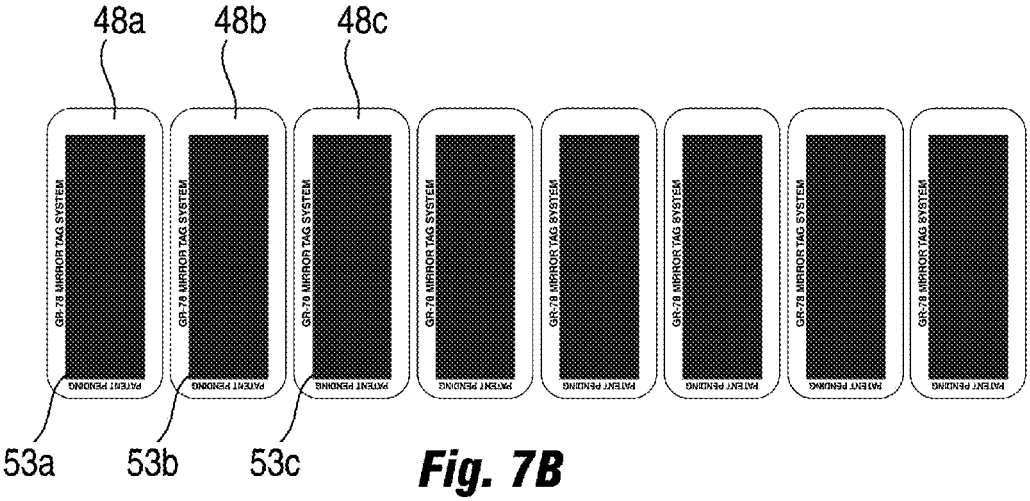

FIG. 7A shows one side of instruction tags 48*a*, 48*b*, 48*c*, etc. Instructions for repair services to be performed, such as, for example, "PDR," "Align/Wheel," "Glass," "A/C," "Detail," "Warning Lamps,"" "Pull-In", "Frame," and "Service," may be provided. FIG. 7B shows the opposite side of instruction tags 48*a*, 48*b*, 48*c*, etc. Each member of the set of instruction tags 48*a*, 48*b*, 48*c*, etc., includes means 53*a*, 53*b*, 53*c*, etc., for releasably attaching one or more of the instruction tags to the mirror tag.

In the "collision repair center" embodiment shown in FIGS. 5-7, the means for attaching the key ring tags 47 and the instruction tags 48*a*, etc., may be provided on the same side of mirror tag 40. This arrangement facilitates storing a greater number of tags in a storage container and avoiding tangling of the hook-and-loop connectors.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tag system for vehicle repair shops, comprising:

a) a mirror tag adapted to be hung from the rear view mirror of a vehicle, wherein said mirror tag includes:
   i) an identifier for identifying the mirror tag;
   ii) attachment means comprising a hook-and-loop fastener for releasably attaching a key ring tag; and
   iii) attachment means comprising a hook-and-loop fastener for releasably attaching one or more members of a set of instruction tags;

b) a key ring tag adapted to retain a key to a vehicle, said key ring tag including:
   i) means for attaching the keys of the vehicle,
   ii) a hook-and-loop fastener for attaching the key ring tag to said mirror tag, and
   iii) an identifier matching the identifier of the mirror tag;

c) a set of instruction tags for communicating instructions regarding the customer and/or the services to be provided to the vehicle and/or the time period during which services are to be provided to the vehicle on which the tag system is hung, wherein said instruction tags each include a hook-and-loop fastener for releasably attaching the instruction tag to said mirror tag; and d) a hook-shaped arm portion for hanging the mirror tag from the rear view mirror of a vehicle.

2. The tag system of claim 1, and further including a storage container for storing and organizing the mirror tags and associated key ring tags and instruction tags.

* * * * *